US005113449A

United States Patent [19]

Blanton et al.

[11] Patent Number: 5,113,449

[45] Date of Patent: May 12, 1992

[54] METHOD AND APPARATUS FOR ALTERING VOICE CHARACTERISTICS OF SYNTHESIZED SPEECH

[75] Inventors: Keith A. Blanton; Ramon E. Helms, both of Plano, Tex.

[73] Assignee: Texas Instruments Incorporated, Dallas, Tex.

[21] Appl. No.: 231,620

[22] Filed: Aug. 9, 1988

Related U.S. Application Data

[63] Continuation of Ser. No. 308,535 Aug. 16, 1982, abandoned.

[51] Int. Cl.[5] ..... G10L 5/00

[52] U.S. Cl. ..... 381/51

[58] Field of Search ..... 381/51-53; 364/513.5

[56] References Cited

U.S. PATENT DOCUMENTS

| | | | |
|---|---|---|---|
| 3,825,685 | 7/1974 | Roworth | 381/54 |
| 3,913,442 | 10/1975 | Deutsch | 84/1.19 |
| 4,076,958 | 2/1978 | Fulghum | 381/51 |
| 4,163,120 | 7/1979 | Baumwolspiner | 381/51 |
| 4,191,853 | 3/1980 | Piesinger | 381/51 |
| 4,241,235 | 12/1980 | McCanney | 381/61 |
| 4,435,832 | 3/1984 | Asada et al. | 381/34 |

OTHER PUBLICATIONS

Flanagan, Speech Analysis, Synthesis and Perception, Springer-Verlag, New York, pp. 212, 230, 344, 368.

*Primary Examiner*—Emanuel S. Kemeny

*Attorney, Agent, or Firm*—William E. Hiller; Richard L. Donaldson

[57] ABSTRACT

Method and apparatus for altering the voice characteristics of synthesized speech to obtain modified synthesized speech of any one of a plurality of voice sounds from a single applied source of synthesized speech, wherein the method relies upon the simulation of an adjustment in the sampling period of the digital speech data from the single applied source of synthesized speech based upon the inequality between first and second reference factors, thereby altering the vocal tract model of the digital speech data to a preselected degree. At the same time, the predetermined pitch period and the predetermined speech rate of the source of synthesized speech remain unchanged. Thus, the altered vocal tract model of the digital speech data from the source of synthesized speech is accompanied by the original pitch period and speech rate of the synthesized speech source in producing modified digital speech data having voice characteristics which are altered with respect to the voice characteristics obtained from the original source of synthesized speech. An audio signal representative of human speech is generated from the modified digital speech data, with the audio signal being converted into audible synthesized speech having voice characteristics different from the voice characteristics of the original source of synthesized speech. Specifically, the altered voice characteristics of the synthesized speech, while capable of being interpreted as coming from a person of different age and/or sex are generally of a quality to be regarded as non-human in origin based upon the audible sound thereof so as to supposedly originate from fanciful or whimsical sources, such as talking animals, birds, monsters, etc.

19 Claims, 8 Drawing Sheets

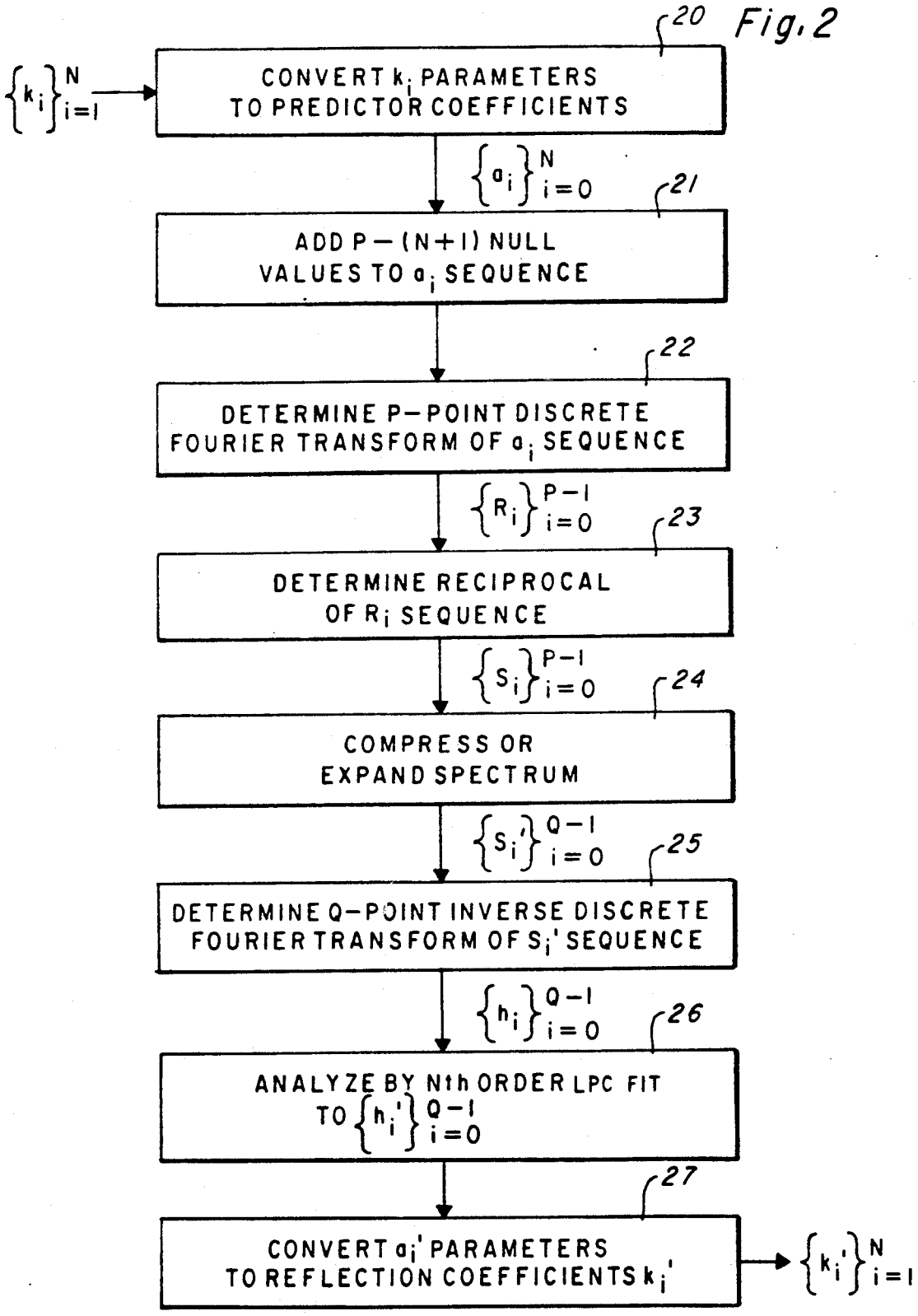
Fig. 2
20
$\{k_i\}_{i=1}^{N}$
CONVERT $k_i$ PARAMETERS TO PREDICTOR COEFFICIENTS
$\{a_i\}_{i=0}^{N}$
21
ADD P−(N+1) NULL VALUES TO $a_i$ SEQUENCE
22
DETERMINE P−POINT DISCRETE FOURIER TRANSFORM OF $a_i$ SEQUENCE
$\{R_i\}_{i=0}^{P-1}$
23
DETERMINE RECIPROCAL OF $R_i$ SEQUENCE
$\{S_i\}_{i=0}^{P-1}$
24
COMPRESS OR EXPAND SPECTRUM
$\{S_i'\}_{i=0}^{Q-1}$
25
DETERMINE Q−POINT INVERSE DISCRETE FOURIER TRANSFORM OF $S_i'$ SEQUENCE
$\{h_i\}_{i=0}^{Q-1}$
26
ANALYZE BY Nth ORDER LPC FIT TO $\{h_i'\}_{i=0}^{Q-1}$
27
CONVERT $a_i'$ PARAMETERS TO REFLECTION COEFFICIENTS $k_i'$
$\{k_i'\}_{i=1}^{N}$ { Si } P-1 i=0
31
DELETE P-Q SAMPLES FROM SEQUENCE
YES
P>Q
30
NO
32
P<Q
YES
33
ADD Q-P NULL VALUES TO SEQUENCE
NO
{ Si' } Q-1 i=0

LOGIC 0
LOGIC 1
J1 J2 K1 K2
J K
40
J-K FLIP-FLOP
CK
CLR FR Q Q̄
INITIALIZATION CIRCUITRY
IDFT CLOCK
45
RECIPROCAL GENERATOR CLOCK
CCLR
CCKEN
41a
COUNTER
RCK
LOGIC 0
C LOAD
LOGIC 1
CLK
C B A
JOINS Fig. 4b
LOGIC 0
32a
P7 P6 P5 P4 P3 P2 P1 P0
P = Q
COMPARATOR
P > Q
Q7 Q6 Q5 Q4 Q3 Q2 Q1 Q0
Q7 Q6 Q5 Q4 Q3 Q2 Q1 Q0
32b
COMPARATOR
P>Q
P7 P6 P5 P4 P3 P2 P1 P0
LINES SET TO P-1

METHOD AND APPARATUS FOR ALTERING VOICE CHARACTERISTICS OF SYNTHESIZED SPEECH

This application is a continuation of Ser. No. 408,535, filed Aug. 16, 1982, now abandoned.

BACKGROUND OF THE INVENTION

This invention generally relates to a method and apparatus for altering the voice characteristics of synthesized speech to obtain modified synthesized speech of any one of a plurality of voice sounds from a single applied source of synthesized speech, wherein audible synthesized speech may be generated from the original source of synthesized speech having a voice quality significantly different and affecting the apparent age and/or sex attributed to the supposed person speaking. In particular, a plurality of voice sounds of apparently non-human origin and of fanciful or whimsical quality such as speaking animals, birds, monsfers etc. are producible from a single source of synthesized speech by effecting a simulated adjustment in the sampling period of the digital speech data from the source of synthesized speech to alter the vocal tract model of the digital speech data to a preselected degree without affecting the pitch period and the speech rate implicit in the original source of synthesized speech.

Generally, speech analysis researchers have appreciated the possibility of changing the acoustical characteristics of a speech signal in a manner altering the apparent voice characteristics associated with the speech signal. In this respect, the article "Speech Analysis and Synthesis by Linear Prediction of the Speech Wave" -Atal and Hanauer, *The Journal of the Acoustical Society of America*, Vol. 50, No. 2 (Part 2), pp. 637-650 (April 1971) describes the simulation of a female voice from a speech signal obtained from a male voice, wherein selected acoustical characteristics of the original speech model were altered, e.g. the pitch, the formant frequencies, and their bandwidths.

Fant in the publication, "Speech Sounds and Features", published by *The MIT Press*, Cambridge, Mass., pp. 84-93 (1973) describes a derived relationship called k factors or "sex factors" between female and male formants in suggesting that these k factors are a function of the particular class of vowels.

In addition, U.S. Pat. No. 4,241,235 McCanney issued Dec. 23, 1980 discloses a voice modification system which relies upon actual human voice sounds as contrasted to synthesized speech, wherein the original voice sounds are changed to produce other voice sounds distinctly different from the original voice sounds. In this voice modification system, the voice signal source is a microphone or a connection to any source of live or recorded voice sounds or voice sound signals. This type of voice modification system is limited in application to situations where direct modification of spoken speech or recorded speech would be acceptable and where the total speech content is of relatively short duration so as not to require significant storage requirements if recorded.

One technique of speech synthesis which has received increasing attention in recent years is linear predictive coding (LPC). It has been found that linear predictive coding offers a good trade-off between the quality and data rate required in the analysis and synthesis of speech, while also providing an acceptable degree of flexibility in the independent control of acoustical parameters.

Text-to-speech systems relying upon speech synthesis have the potential of providing synthesized speech with a virtually unlimited vocabulary as derived from a prestored component sounds library which may consist of allophones or phonemes, for example. Typically, the component sounds library comprises a read-only-memory whose digital speech data representative of the voice components from which words, phrases and sentences may be formed are derived from a male adult voice. A factor in the selection of a male voice for this purpose is that the male adult voice in the usual instance offers a low pitch profile which seems to be best suited to speech analysis software and speech synthesizers currently employed. The provision of audible synthesized speech with varying voice characteristics depending upon the identity of the characters in the text of a text-to-speech system relying upon synthesized speech from a male voice could be rendered more flexible without requiring any increase in memory storage by altering the voice characteristics of the original source of synthesized speech to produce a plurality of voice sounds of different speech character depending upon the identity of the characters in the text. In this respect, copending U.S. patent application Ser. No. 375,434 filed May 6, 1982, now U.S. Pat. No. 4,624,012 issued Nov. 18, 1986, discloses a method and apparatus for converting the voice characteristics of synthesized speech as obtained from a single applied source of synthesized speech. The technique for converting the voice characteristics of synthesized speech as disclosed in the latter U.S. application, now U.S. Pat. No. 4,624,012, relies upon separating the pitch period, the vocal tract model, and the speech rate as contained in the source of synthesized speech into the respective speech parameters, with the values of pitch and the speech data rate being then varied in a preselected manner as determined by a selected change in the sampling rate while the vocal tract model is retained in its original form. The changed speech data parameters are then recombined with the original vocal tract model to create a modified synthesized speech data format having different voice characteristics with respect to the synthesized speech from the source. Thus, the technique described in the aforesaid U.S. application Ser. No. 375,434 filed May 6, 1982, now U.S. Pat. No. 4,624,012, in its preferred form involves actual changing of the sampling rate, with the modified sampling rate being employed with the original pitch period data and the original speech rate data in the development of a modified pitch period and a modified speech rate for re-combining with the original vocal tract speech parameters in producing the modified speech data format from which audible synthesized human speech may be generated via a speech synthesizer and an audio means having different voice characteristics from the synthesized human speech which would have been obtained from the original source of synthesized speech.

SUMMARY OF THE INVENTION

In accordance with the present invention, a method and apparatus are provided for altering the voice characteristics of synthesized speech to obtain modified synthesized speech of any one of a plurality of voice sounds from a single applied source of synthesized speech, wherein the method significantly departs from the approach taken in the aforementioned U.S patent application Ser. No. 375,434 filed May 6, 1982, now U.S. Pat. No. 4,624,012, in that the individual speech parameters including the pitch period, the vocal tract model, and the speech rate associated with the original source of synthesized speech are not separated and individually modified, nor is the sampling period actually adjusted. Instead, the present method relies upon establishing first and second reference factors of unequal magnitude, wherein the first reference factor is based upon the desired modified synthesized speech to be created, and the simulation of an adjustment in the sampling period of the digital speech data from the source of synthesized speech as based upon the inequality between the first and second reference factors. The simulated adjustment in the sampling period of the digital speech data from the original source of synthesized speech effectively alters the vocal tract model of the digital speech data to a preselected degree, whereas the pitch period and the speech rate remain unchanged. The modified digital speech data as so created by the simulated adjustment in the sampling period thereof has altered voice characteristics as compared to the synthesized speech from the source thereof. A speech synthesizer device upon receiving the modified digital speech data generates audio signals representative of human speech which are converted by audio means, such as a loud speaker, into audible synthesized speech having altered voice characteristics from the synthesized speech which would have been obtained from the source of synthesized speech.

Depending upon whether the first reference factor is , greater or less in magnitude as compared to the second reference factor, the simulated adjustment in the sampling period of the digital speech data from the source of synthesized speech effectively compresses or expands the synthesized speech spectrum by a predetermined amount as established by the magnitude of the first and second reference factors and the relative inequality therebetween. Thus, when the first reference factor has a greater magnitude than the second reference factor, the synthetic speech spectrum is compressed by the simulated adjustment in the sampling period of the digital speech data from the source of synthesized speech. Alternatively, where the first reference factor is of lesser magnitude as compared to the second reference factor, the synthetic speech spectrum is expanded. In either instance, initially a predetermined number of null values are added to the plurality of predictor coefficients as obtained from appropriate conversion of the reflection coefficients comprising the vocal tract model represented by the digital speech data in a first phase thereof. Thereafter, the digital speech data is converted from the first phase to a second phase in which the plurality of added null values are absorbed. After the digital signal sequence has been changed to the frequency domain from the time domain, it is subjected to either compression or expansion depending upon the nature of the inequality between the first and second reference factors in simulating an adjustment in the sampling period. A digitized speech waveform is then produced from the digital speech data as it exists in its compressed or expanded synthetic speech spectrum as an impulse response from which pitch period information and amplitude information have been deleted by returning the spectrum to the time domain from the frequency domain. This digitized speech waveform is then analyzed in providing the modified digital speech data having an altered vocal tract model comprising a plurality of digital values representing reflection coefficient parameters, at least some of which are of changed magnitude with respect to the digital values representative of the reflection coefficient parameters of the digital speech data from the original source of synthesized speech.

Thus, a wide variety of voice sounds may be obtained from a single source of synthesized speech by employing the method and apparatus according to the present invention, wherein the voice sounds may be generally interpreted as whimsical in character such as might be spoken by an imaginary talking animal, e.g. a chipmunk, a squirrel, etc. in the instance where the synthetic speech spectrum is expanded which increases the formant frequencies of the digital speech data, thereby simulating a shrinking of the vocal tract and giving the impression that the audible synthesized speech as generated therefrom was spoken by a creature or person of small size. Conversely, spectral compression of the synthetic speech spectrum causes a decrease in the formant frequencies of the digital speech data from the original source of synthesized speech, thereby simulating an enlargement of the vocal tract and giving the impression that the synthesized speech as audibly generated was spoken by a physically larger being, such as a monster, demon, etc.

It is also contemplated that independent of the spectral transformations in the synthetic speech spectrum, the magnitude of the pitch parameter and the pitch contour may be modified to further enhance the dimension of voice character modification which may be accomplished without actually changing the sampling rate of the digital speech data.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings wherein:

FIG. 2 is a flow chart illustrating in diagrammatic form the method of altering the voice characteristics of synthesized speech from a single applied source of synthesized speech in accordance with the present invention;

DETAILED DESCRIPTION OF THE INVENTION

Referring more specifically to the drawings, the method and apparatus disclosed herein are effective to alter the voice characteristics of synthesized speech from a single applied source of synthesized speech as employed in a fixed sampling rate linear predictive coding (LPC) speech synthesis system in a manner obtaining modified synthesized speech of any one of a plurality of voice sounds with apparent differences in age and/or sex of the speakers. In particular, the number of voice sounds which may be produced from a single source of synthesized speech in accordance with the technique of the present invention include whimsical voice sounds seemingly of non-human origin, such as might be imagined from a speaking animal (e.g. a chipmunk, a squirrel, etc.) having what appears to be a high attendant pitch. At the other end of the synthetic speech spectrum, the plurality of voice sounds which may be produced in accordance with the present invention may be imagined as demonic or monster-like in quality and tone as characterized by a seemingly low pitch. At the heart of the present invention is the provision of a simulated adjustment in the sampling period of the digital speech data from the source of synthesized speech altering the vocal tract model of the digital speech data to a preselected degree, thereby altering the voice characteristics of the audible synthesized speech as generated by audio means in the form of a loud speaker connected to the output of a speech synthesizer to which the modified digital speech data is directed.

Figure 1A:
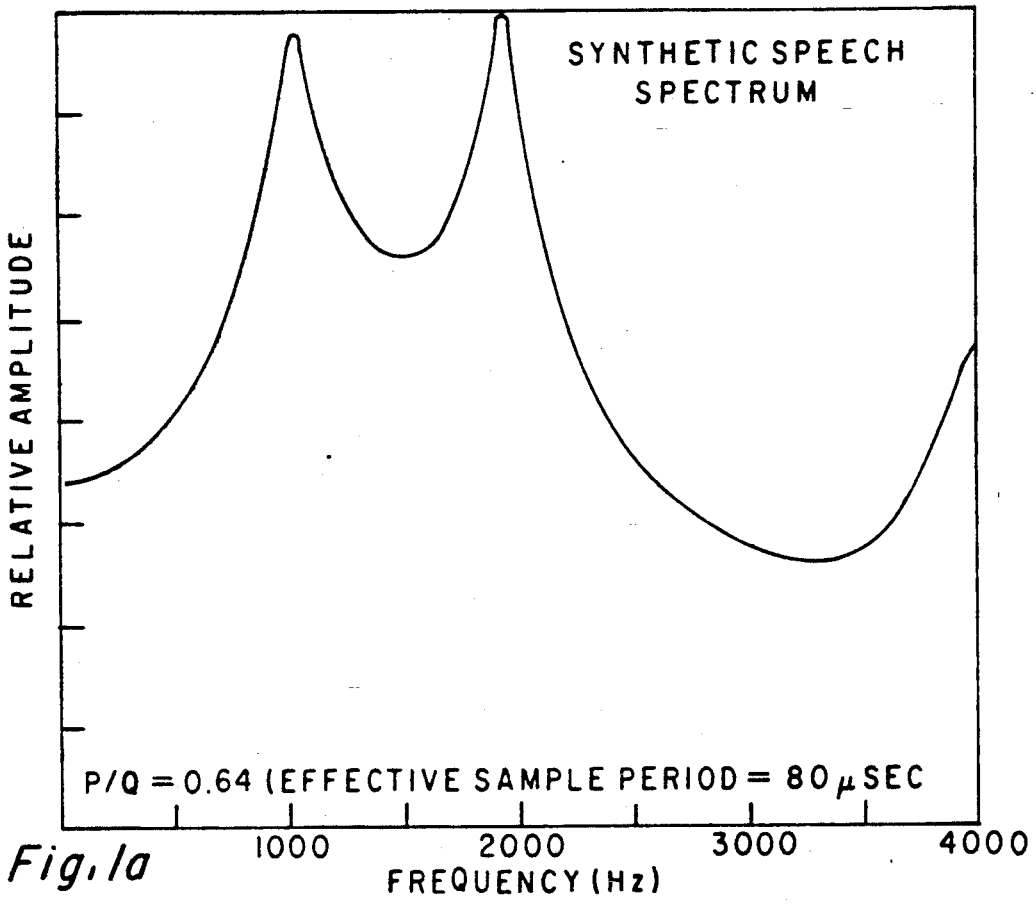
FIGS. 1*a*–1*d* are respective graphical representations showing a synthetic speech spectrum as obtained from the same digital speech data of a single source of synthesized speech as in FIG. 1*c*, the synthetic speech spectrum being modified in FIGS. 1*a*, 1*b* and 1*d* in accordance with a simulated adjustment of the sample period.
Figure 1B:
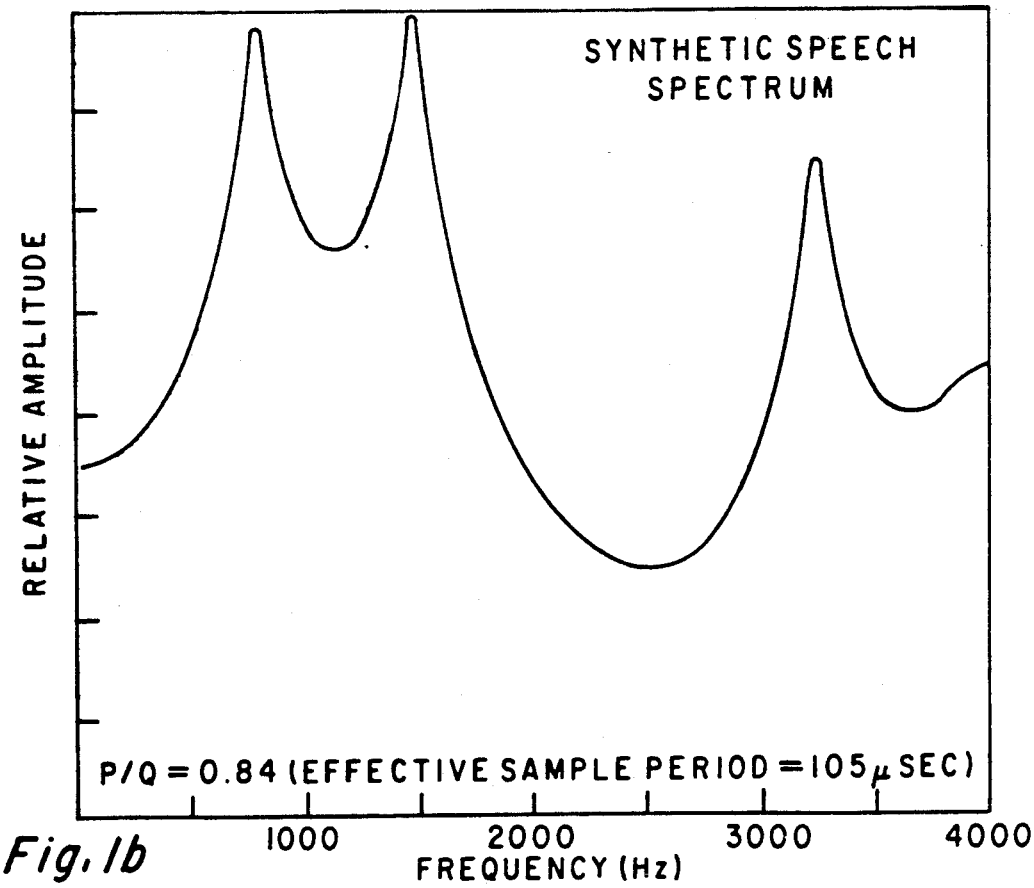
Figure 1C:
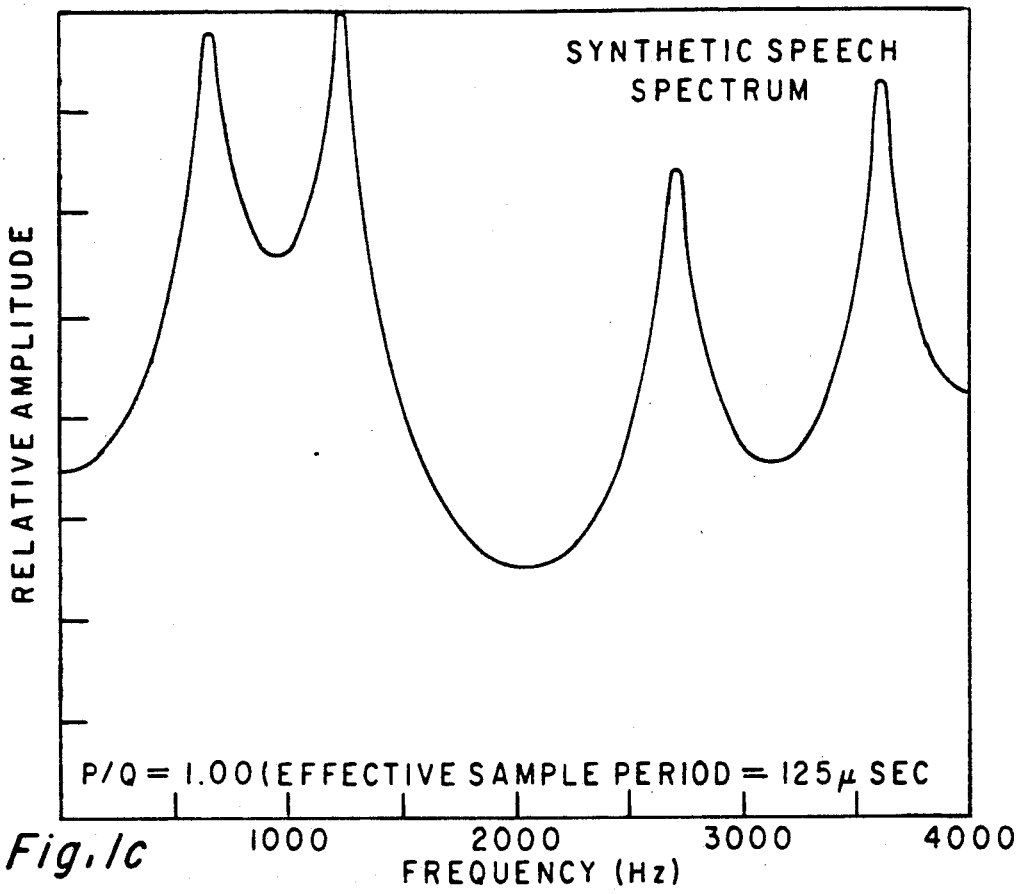
Figure 1D:
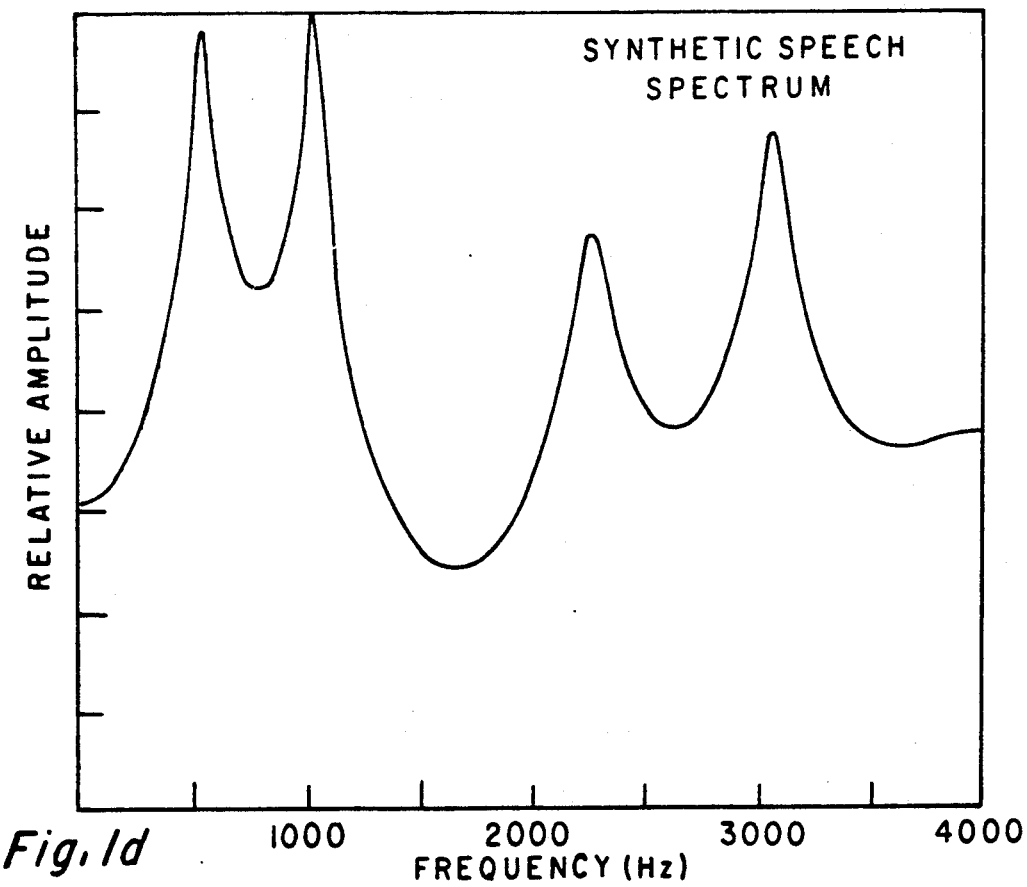

As shown, FIG. 1*c* is a graphical representation of the synthetic speech spectrum from the digital speech data of the source of synthesized speech with the normal voice characteristics associated therewith in that the synthetic speech spectrum has not been transformed either by compression or expansion thereof in accordance with the technique described herein. FIGS. 1*a* and 1*b* respectively illustrate expanded versions of the original synthetic speech spectrum of FIG. 1*c*, FIG. 1*a* being representative of an approximately 36% expansion of the synthetic speech spectrum and causing a shift in the spectrum comparable to that which an actual sample period change from 125 microseconds to 80 microseconds would effect. FIG. 1*b* is representative of an approximately 16% expansion of the synthetic speech spectrum of FIG. 1*c* and shows a shift in the synthetic speech spectrum comparable to that which a sample period change from 125 microseconds to 105 microseconds would effect. FIG. 1*d* is a graphical representation showing a compression of the synthetic speech spectrum of FIG. 1*c* approximating 20%, wherein the synthetic speech spectrum has been shifted to the same degree that a change in the sample period from 125 microseconds to 150 microseconds would effect.

In general, it may be said that an expansion of the synthetic speech spectrum shown in FIG. 1*c* as effected in each of the illustrations in FIGS. 1*a* and 1*b* causes an increase in formant frequencies simulating a shrinking of the vocal tract size and giving an impression that the audible synthesized speech produced therefrom was spoken by a being of a relatively small size. Conversely, a compression of the synthetic speech spectrum shown in FIG. 1*c* as effected in the illustration of FIG. 1*d*causes a decrease in formant frequencies, thereby simulating an enlargement of the vocal tract and giving the impression that the audible synthesized speech produced therefrom was spoken by a person or being of relatively large physical size.

Additional description of the showings in FIGS. 1*a*–1*d* will ensue, following a detailed description of the method and apparatus of altering the voice characteristics of synthesized speech from a single applied source of synthesized speech in accordance with the present invention. As an initial source of LPC synthesized speech, the speech parameters including pitch, energy and k speech parameters representative of reflection coefficients are available from a single source, such as a read-only-memory 10 (FIG. 5) having digital speech data and appropriate digital control data stored therein for selective use by a speech synthesizer 11 in generating analog speech signals representative of human speech. In this respect, in accordance with a preferred form of the invention, an adjustment in the sampling period of the digital speech data is simulated by effecting a transformation of the synthetic speech spectrum where the input and output LPC speech parameters are in the form of digital speech data representative of reflection coefficients, the LPC model order is N, with $F_{OLD}$= the implied sampling frequency of the LPC parameters before transformation of the synthetic speech spectrum; and $F_{NEW}$= the desired apparent sampling frequency of the LPC parameters after transformation of the synthetic speech spectrum. A first reference factor P and a second reference factor Q are chosen such that Q=the nearest even integer to $P.F_{NEW}/F_{OLD}$ for subsequent use in the simulation of an adjustment in the sampling period. Q should be an even number to avoid producing a complex impulse response during an intermediate stage of the method. In the flow chart of FIG. 2, initially the $k_1, k_2, \ldots, k_N$ speech parameters representative of reflection coefficients are converted to predictor coefficients $a_0, a_1, \ldots, a_N$ at 20 via an established procedure, such as the "step-up procedure" set forth in the publication "Linear Prediction of Speech"- Markel & Gray, published by Springer-Verlag, Berlin, Heidelberg, N.Y. (1976) at pages 94-95 thereof. Thereafter, a total of P-(N+1) artificial null values or zeroes are added to the sequence of predictor coefficients as at 21 to define the sequence as $a_0, a_1, \ldots, a_N, 0, 0, \ldots, 0$ which may be stated as $a_0, a_1, \ldots, a_N, a_{N+1}, a_{N+2}, \ldots, a_{P-1}$. The predictor coefficients corresponding to the k speech parameters and including the added null values are then employed in determining a discrete Fourier Transform (DFT) of the digitized speech waveform having a number of paints corresponding to the first reference factor P. In the instance, as a means of simulating an adjustment of the sampling period of the digital speech data to achieve altered voice characteristics, the first reference factor P and the second reference factor Q are established as previously described, the magnitudes of which are based upon the desired voice characteristics to be achieved from the modified digital speech data as produced by the simulated adjustment of the sampling period. Thus, P, the first reference factor, may equal any number of predetermined points as determined by type of voice desired to be made, whereas Q, the second reference factor, may be any number of points in an inverse discrete Fourier transform (IDFT). In this instance, the second reference factor Q affects the memory storage limits and the speed of the apparatus in altering the voice characteristics of synthesized speech, with an increase in the magnitude of Q increasing the resolution quality of the modified synthesized speech to be audibly spoken. In order to effect a transformation in the synthetic speech spectrum in accordance with the present invention, the first reference factor P and the second ref factor Q must be of unequal magnitudes. In the special instance where P equals Q, no transformation of the synthetic speech spectrum from that obtained from original source of synthesized speech occurs which condition illustrated by the graphical represent at FIG. 1c, where the ratio of P/Q equals 1.00 with effective sample period of 125 microseconds.

Having established the respective magnitude of the first and second reference factors P and P-point DFT of the sequence of predictor come with the added null values is determined which effectively causes the null values added in the previous step of the method to be absorbed or to disappear, when the DFT is employed to place the digital signal data in the frequency domain as at 22 in the flow chart of FIG. 2. The determination of the P-point DFT may be effected by em a suitable technique, such as that described in "Digital Signal Processing"- Oppenheim & Shafer, published by Prentice-Hall. At this stage, the individual speech parameters may be identified as $R_0, R_1, \ldots, R_{P-1}$. The reciprocal value of $R_i$ is now determined as at 23 by inverting the digital speech values $R_0, R_1, \ldots, R_{P-1}$ obtained in determining the P-point DFT of the predictor coefficients. This basically converts the digital speech data from that employed in an inverse synthesis filter to a forward synthesis filter. The digital speech data may be now identified as values $S_0, S_1, \ldots, S_{P-1}$. At this stage the transfer function H(z) of the digital filter has been transferred to the frequency domain and the digital speech data has been placed in a form comparable to a non-transformed synthetic speech spectrum. In accordance with the present invention, the method herein disclosed provides for the generation of a transformed synthetic speech spectrum involving digital speech data representative of reflection coefficients.

To this end, the synthetic speech spectrum is now compressed or expanded as at 24 in FIG. 2 depending upon the relative magnitudes of the first and second reference factors P and Q. The difference between the magnitudes of P and Q accomplishes a simulated adjustment of the sampling rate to achieve alteration in the voice characteristics attributed to the synthesized speech. Where P=Q, as depicted in FIG. 1c such that the ratio P/Q=1.00, no voice change occurs as the synthetic speech spectrum is not transformed and is the same spectrum of the original digital speech data from the source of synthesized speech. If P>Q such that the ratio P/Q is greater than 1.00, a compression of the synthetic speech spectrum from the original source occurs which effectively decreases the formant center frequencies and their bandwidths as shown in the graphical representation illustrated in FIG. 1d. In this instance, P-Q samples of digital speech data are deleted from the middle of the spectral sequence $S_i$ represented by the signals-$S_0, S_1, \ldots, S_{P-1}$ to obtain the sequence $S_i'$, i=0, Q-1. For example, where the first reference factor P is assigned the magnitude of 256 and the second reference factor Q is assigned the magnitude of 150, the terms of the signals $S_i$ as modified to produce $S_i'$ may take the following forms, such that the terms deleted from the sequence $S_i$ in forming the sequence $S_i'$ are taken from the middle of the spectral sequence.

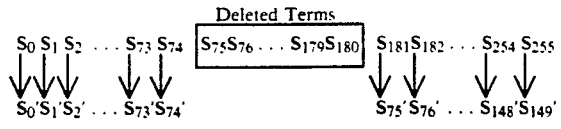

Formally, the above alteration may be expressed as $$S_i' = S_i, \quad i = 0, Q/2 - 1$$
$$S_i' = S_{i+P-Q}, \quad i = Q/2, Q - 1.$$

Where the synthetic speech spectrum is to be expanded which is the case when Q>P such that the ratio P/Q is less than 1.00, then Q - P samples are added to the middle of the spectral sequence $S_i$, each having a value of zero, to obtain the sequence $S_i'$, i=0, Q-1. For example, assigning the magnitudes to the first and second reference factors such that P equals 256 and Q equals 400, the following conversion terms of $S_i$ to $S_i'$ occurs

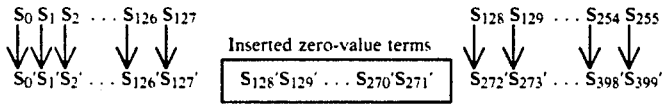

Formally, this may be expressed as:

$$S_i' = S_i, \quad i = 0, P/2 - 1$$
$$S_i' = 0, \quad i = P/2, Q - 1 - P/2$$
$$S_i' = S_{i-P-Q}, \quad i = Q - P/2, Q - 1.$$

This technique involves an apparent change in the speed of the signal comprising the digital speech data without an actual change in the speed, thereby simulating a sample rate change rather than actually imparting such as sample rate change.

At this stage, the Q-point inverse discrete Fourier transform (IDFT) is determined for the sequence $S_0'$, $S_1', S_2', \ldots, S_{Q-1}'$ as at 25 in FIG. 2 to establish the signal sequency $h_0', h_1', 2', \ldots, h'_Q$. The signal sequence is the desired impulse response of the speech synthesis filter where the linear predictive coding speech parameters have been modified to simulate a change in the sampling rate. This accomplishes returning the synthetic speech spectrum from the frequency domain to the time domain where the speech data exists as a digitized speech waveform having no pitch information and no energy information. Such a digitized speech waveform is similar to the digitized speech employed in a speech analysis portion.

In a preferred instance, the magnitude of Q may be defined to be a power of 2 since this would enable a special form of IDFT to be employed, an inverse fast Fourier transform (IFFT), instead of the more general IDFT following compression or expansion of the synthetic speech spectrum as at 24 in FIG. 2. Where an IFFT is performed, the execution speed of the signal processing technique is significantly enhanced. In this instant, P equals the nearest even integer to $Q.F_{OLD}/$-

$F_{NEW}$. The use of the IFFT form allows the data rate of the voice characteristics altering apparatus to have a speed approximately proportional to Q.log Q, whereas the speed is proportional to $Q_2$ when the IDFT is used.

The signal sequence $h_0'$, $h_1'$, $h_2'$, . . . , $h'_{Q-1}$ is now analyzed by being subjected to an Nth order linear predictive coding fit as at 26 in FIG. 2 to obtain digital speech data representative of altered reflection coefficients $k_1'$, $k_2'$, $k_3'$, . . . , $k_N'$, thereby altering the vocal tract model of the digital speech data to a preselected degree as desired. In establishing the digital values representative of the altered vocal tract model as $k_1'$, $k_2'$, $k_3'$, . . . , $k_N'$ by subjecting the signal sequence $h_0'$, $h_1'$, $h_2'$. . . , $h_{Q-1}'$ to an Nth order LPC fit, the technique described in the aforementioned publication "Linear Prediction of Speech"-Markel & Gray on pages 10–15 may be performed to obtain digital speech data representative of predictor coefficients ai which are then converted to digital speech values representative of reflection coefficients $K_1'$as at 27 in FIG. 2 as described on pages 95–97.

Thus, FIGS. 1*a* and 1*b* are graphical representations showing expansion of the original synthetic speech spectrum shown in FIG. 1*c*, where the magnitude of Q is greater than the magnitude of P, and FIG. 1*d* illustrates a graphical representation of a compressed synthetic speech spectrum where the magnitude of P is greater than that of Q.

Figure 3:
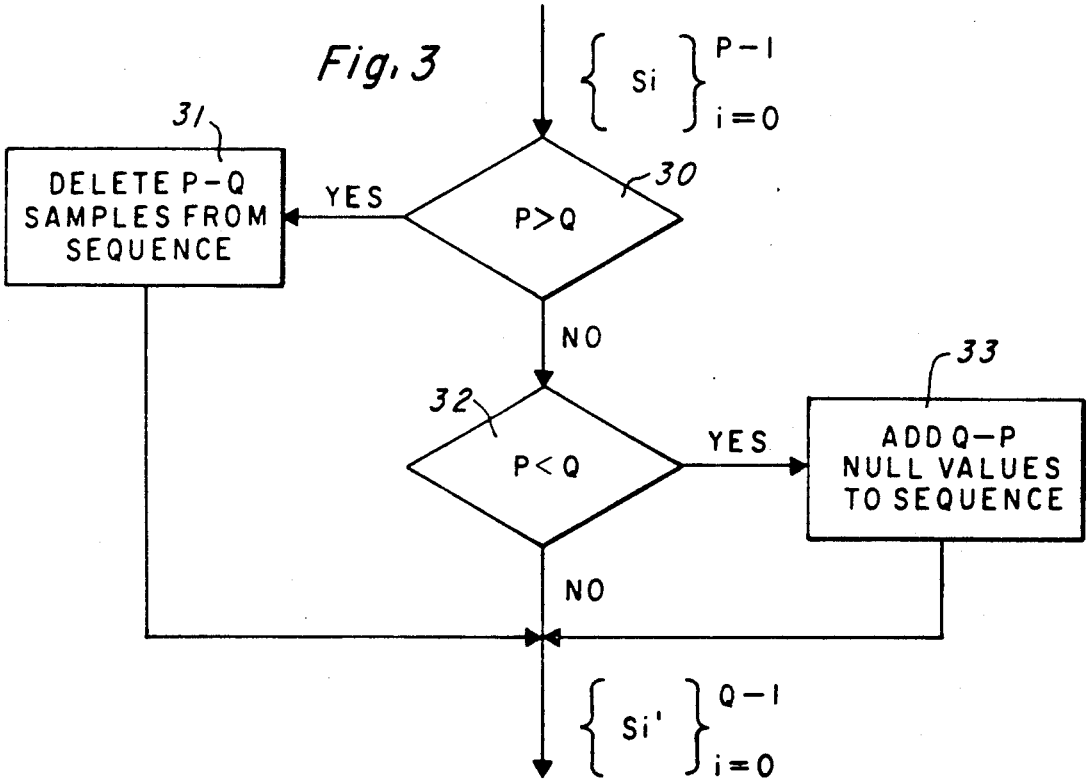
FIG. 3 is a logic diagram further explanatory of the sequence in the flow chart of FIG. 2, wherein an adjustment in the sampling period of the digital speech data from the source of synthesized speech is simulated by either compressing or expanding the synthetic speech spectrum.

Referring now to FIG. 3, a logic diagram is illustrated further identifying the sequence 24 of FIG. 2 with reference to compression or expansion of the original synthetic speech spectrum as dependent upon the relative magnitudes of the first and second reference factors P and Q. To this end, it will be observed that the signal sequence as determined at phase 23 of FIG. 2 and denoted by $$\{S_i\}_{i=0}^{P-1}$$

is received as an input by a comparator device 30 which has established threshold values based upon the first reference factor P being greater than the second reference factor Q. If this inequality is true, the comparator 30 provides an output signal to a control circuit 31 which performs the procedure of deleting P-Q samples from the middle portion of the signal sequence in producing as a signal output the sequence $$\{S_i'\}_{i=0}^{Q-1}.$$

On the other hand, if the comparator unit 30 determines that the inequality P is greater than Q is false, then the comparator unit 30 provides an alternative output to a second comparator unit 32 having threshold values based upon P being less than Q. If this inequality is true, the comparator unit 32 provides an output to a control circuit 33 which adds Q-P null values as complex zeros to the middle of the signal sequence in providing the transformed signal sequence $$\{S_i'\}_{i=0}^{Q-1}$$

thereof. If the inequality P is less than Q is false, then the second comparator unit 32 provides as an alternative output a non-transformed signal sequence, since this would mean that P equals Q.

As described in connection with FIGS. 2 and 3, compression or expansion of the synthetic speech spectrum from the original source is achieved by deleting P-Q sample values from the middle of the spectral sequence $S_i$ or adding Q-P null values to the middle of the spectral sequence $S_i$, as the case may be, to obtain a transformed synthetic speech spectrum. In this instance, the complete spectral sequence Si is involved which characteristically is comprised of first and second spectral sequence portions, wherein the second spectral sequence portion is a "mirror image" of the first spectral sequence portion. It is thus possible to perform the method in accordance with the present invention on the first spectral sequence portion alone and to ignore the second spectral sequence portion of the complete spectral sequence $S_i$. This approach offers a practical aspect in that the deletion or addition of sample values to the synthetic speech spectrum from the original source of synthesized speech in simulating an adjustment in the sampling period by compressing or expanding the synthetic speech spectrum can be accomplished in relation to the trailing end of the first spectral sequence portion without requiring the added complexity of performing this operation in relation to the middle of the complete spectral sequence $S_i$. Thus, utilizing as a signal sequence to be operated upon only the first spectral sequence portion of the complete spectral sequence $S_i$ has the effect of simplifying the circuitry of the apparatus for altering the voice characteristics of synthesized speech in practicing the method herein disclosed. Where the first spectral sequence portion is employed as the signal sequence $S_i$, it will be understood that the number of deleted sample values or added null values is halved. Thus, in FIG. 3, for example, the control circuit 31 would be responsible for deleting $P-Q/2$ sample values from the end of the signal sequence $S_i$ when the comparator unit 30 indicates that the inequality $P>Q$ is true. Alternatively, the control circuit 33 would be responsible for adding $Q-P/2$ null values to the end of the signal sequence $S_i$ if the inequality $P<Q$ is true.

Figure 4A:
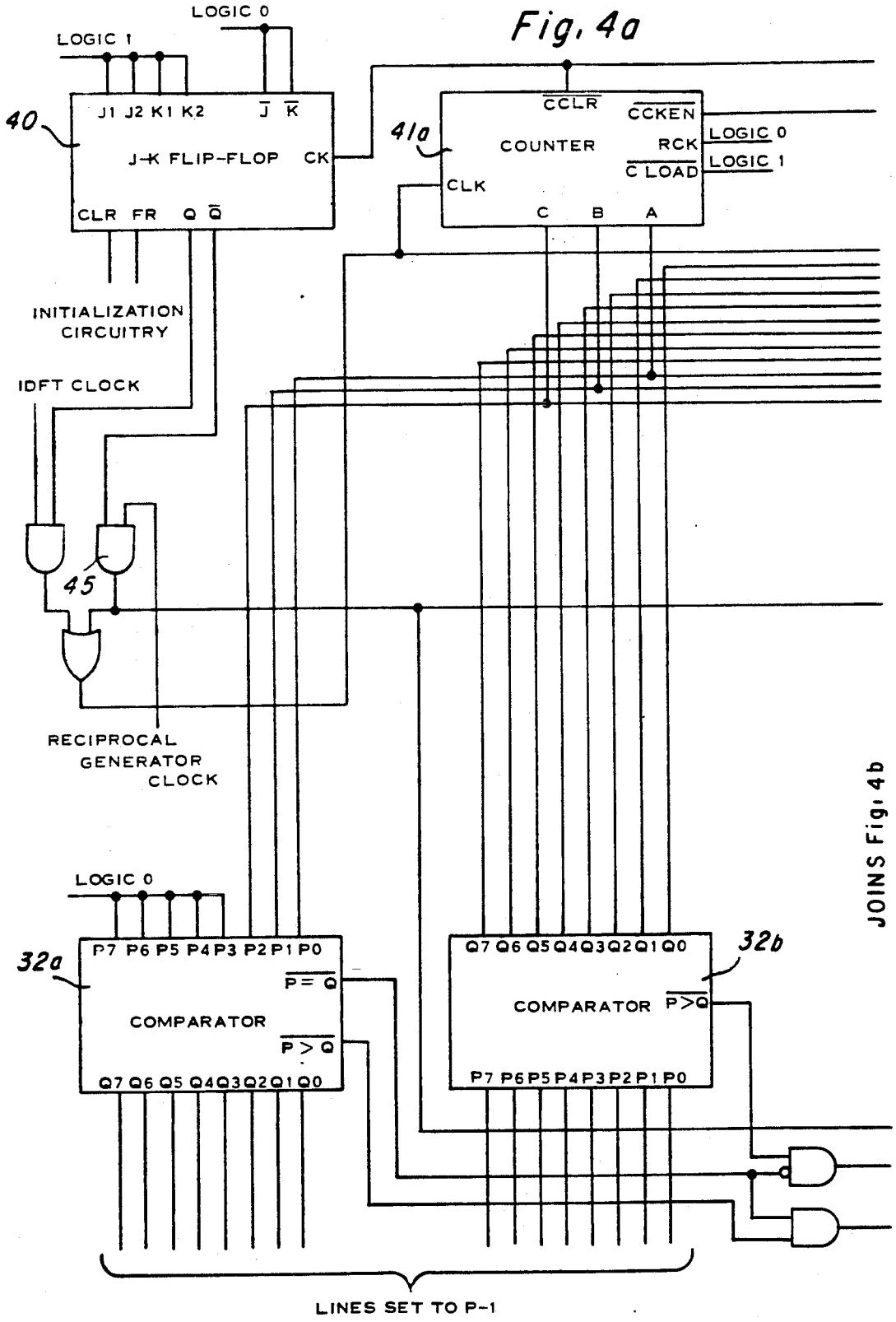
FIGS. 4*a* –4*c* are respective circuit schematics comprising a composite circuit schematic of an apparatus for altering the voice characteristics of synthesized speech from a single applied source of synthesized speech in accordance with the present invention.
Figure 4B:
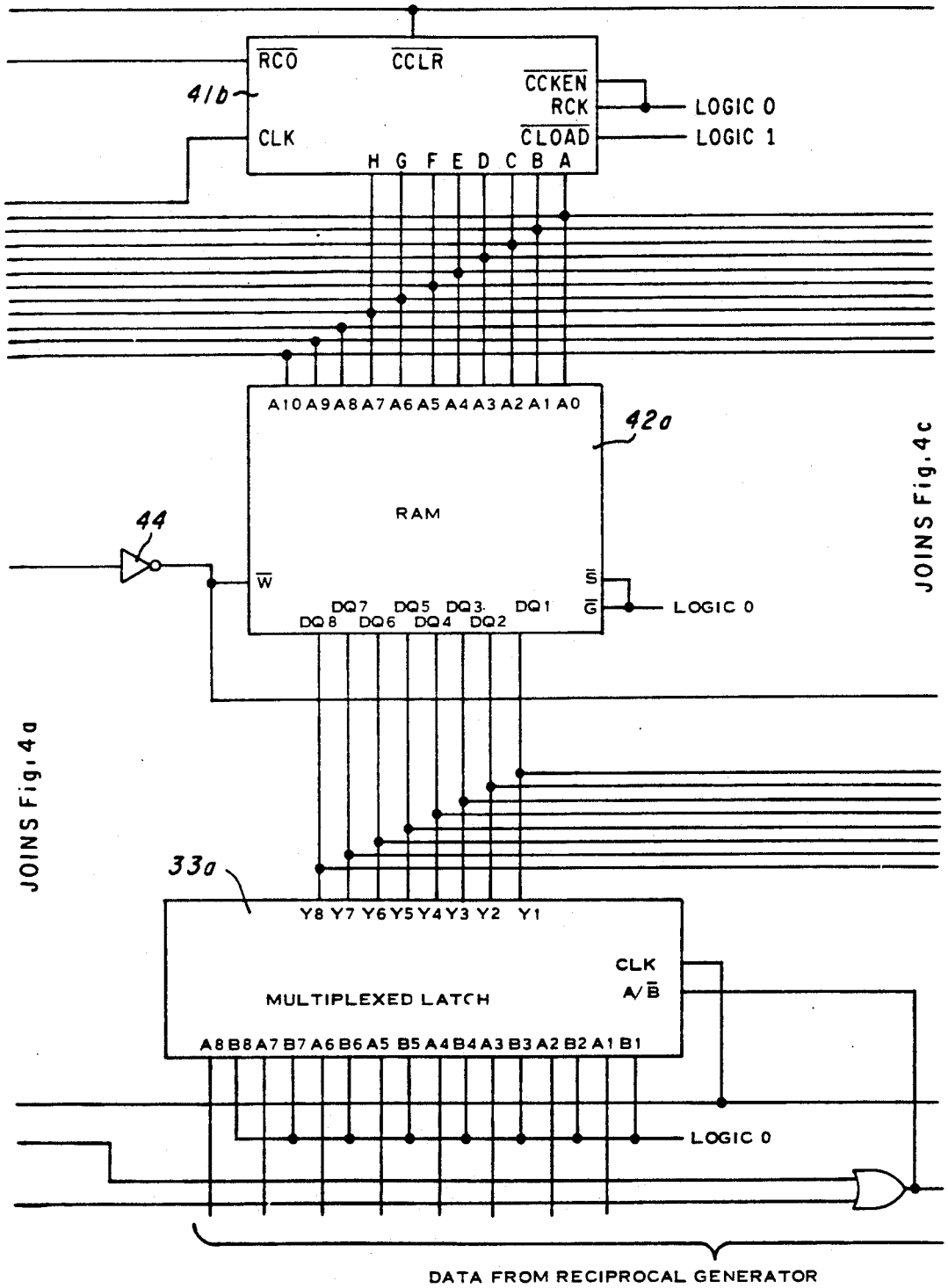
Figure 4C:
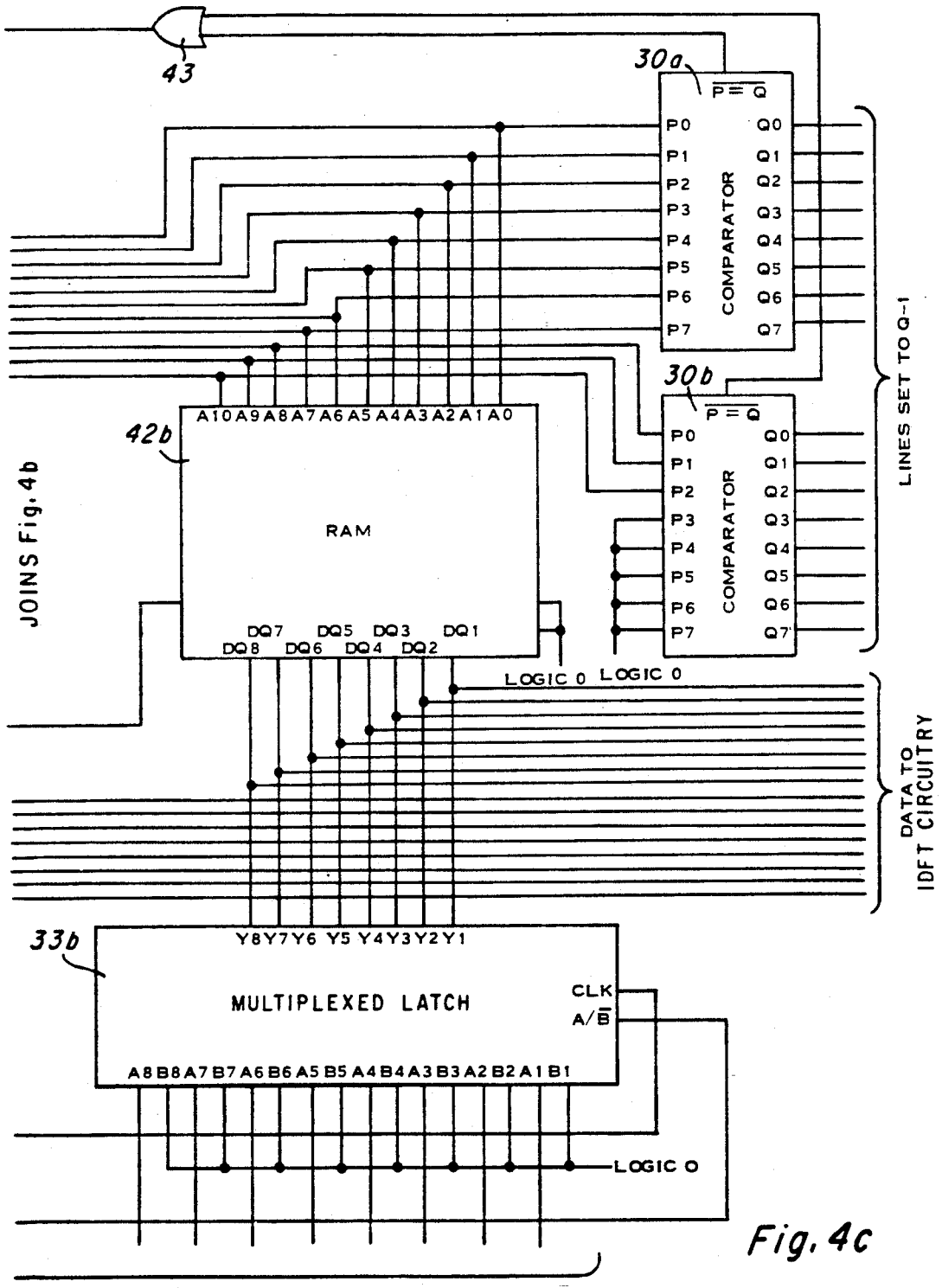

In the latter respect, FIGS. 4*a*–4*c* illustrate an apparatus for altering the voice characteristics of synthesized speech from a single applied source thereof in accordance with the present invention, wherein the apparatus operates on the trailing end of the signal sequence as defined by the first spectral sequence portion of the complete spectral sequence $S_i$. Thus, $P-Q/2$ sample values are deleted from the end of the signal sequence when the first reference factor P is greater than the second reference factor Q by the apparatus of FIGS. 4*a*–4*c* and $Q-P/2$ null values are added to the end of the signal sequence when the first reference factor P is less than the second reference factor Q.

Referring to the apparatus illustrated in FIGS. 4*a*–4*c* the apparatus receives P-point discrete Fourier transform values and provides as an output Q-point discrete Fourier transform values. If the first reference factor P is greater than the second reference factor Q, the input sequence is truncated to obtain the output sequence, whereas if P is less than Q, artificial samples having values of zero are added to the end of the input sequence to produce the output sequence. Assuming that the magnitudes of the first and second reference factors P and Q have been determined in relation to the first spectral sequence portion only of the complete spectral sequence $S_i$ (thereby halving the magnitudes which would be determined for P and Q over the complete spectral sequence), then P-Q sample values are deleted from the end of the input sequence or Q-P null values are added to the end of the input sequence. As shown, each of the sequence values is represented by 16 bits of data, such that two identical 8-bit component devices have been paired, as necessary, to perform the equivalent 16-bit function in the apparatus circuit. It will be understood that a single component having the requisite bit capacity could be employed in place of the paired sets of components, as illustrated. For example, a single comparator unit 30 (as in FIG. 3) could be substituted for the comparator units 30*a*, 30*b* which are set to the threshold value Q-1.

The apparatus of FIGS. 4*a*–4*c* includes a switching device 40 which may take the form of a J-K flip-flop available as an integrated circuit SN7470 from Texas Instruments Incorporated of Dallas, Tex. The J-K flip-flop 40 alternately switches control of the apparatus circuitry between the reciprocal generator operable in stage 23 of the method as depicted in FIG. 2 and the inverse discrete Fourier transform processor operable during stage 25 and at the output side of the synthetic speech spectrum transformation effected at stage 24. When a turnover in control as between the reciprocal generator and the IDFT processor occurs, the comparator 30*a*, 30*b* provides a pulse clearing a counter 41*a*, 41*b*. When the reciprocal generator of stage 23 has control, memory means in the form of a random access memory 42*a*, 42*b* is set for writing. Otherwise the RAM 42*a*, 42*b* is set for read-only access. The counter 41*a*, 41*b* is an incrementing counter and counts from zero through Q-1, storing the respective frequency values associated with the counts in teh RAM 42*a*, 42*b*. If the count is less than the value of P, the comparator unit 32*a*, 32*b* sets the control lines for the multiplexed latch 33*a*, 33*b* (corresponding to the control circuit 33 of FIG. 3, for example) so that data from the reciprocal generator is stored in the RAM 42*a*, 42*b*. Once the count reaches the value of P, the multiplexed latch 33*a*, 33*b* passes a null value of zero to the RAM 42*a*, 42*b* for each count thereafter. The $\overline{J}$ and $\overline{K}$ inputs to the J-K flip-flop circuit 40 are both set to logic "0", causing each pulse to the CK input to toggle the values of Q and $\overline{Q}$. When Q has a logic value of "0" ($\overline{Q}$="1"), the timing pulses from the reciprocal generator are used to control the apparatus circuit. When Q has a logic value of "1" ($\overline{Q}$="0"), the timing pulses of the IDFT processor are used to control the apparatus circuit.

As explained, the two 8-bit counters 41*a*, 41*b* are configured (via the connection between the $\overline{RCO}$ output of the least significant counter to the $\overline{CCKEN}$ input of the most significant counter) to form a single 16-bit counter. Upon receiving the proper timing pulse from either the reciprocal generator or the IDFT processor, the counter 41*a*, 41*b* increments by one as long as the $\overline{CCLR}$ inputs have values of logic "1". If the $\overline{CCLR}$ inputs have values of logic "0", the timing pulse causes the counter 41*a*, 41*b* to reset (both 8-bit counters 41*a* and 41*b* assume values of zero).

The comparator 30*a*, 30*b* compares the current value of the counter 41*a*, 41*b* with: the value Q−1. When the counter 41*a*, 41*b* reaches this value, the $\overline{P}=\overline{Q}$ Q/ outputs of the comparator 30*a*, 30*b* have values of logic "0" which causes the output of the OR gate 43 connected to the $\overline{CCLR}$ inputs of the counter 41*a*, 41*b* to be logic "0". The subsequent timing pulse will thereby reset the counter 41*a*, 41*b*.

The RAM 42*a*, 42*b* has a total storage capability of 2048 16-bit values, as provided by two paired static RAMs offering 2048 8-bit storage each and available as integrated circuit TMS4016 from Texas Instruments Incorporated of Dallas, Tex. The output of the counter 41*a*, 41*b* is used as the RAM address. The $\overline{W}$ inputs of the RAM 42*a*, 42*b* are connected to a logic inverter 44 which in turn is connected to an AND gate 45 responsible for generating the logical AND of the reciprocal generator timing pulses and the $\overline{Q}$ output of the J-K flip-flop device 40. When $\overline{Q}$ has a value of logic "1" (and the reciprocal generator timing pulse has a value of logic "1"), values obtained from the reciprocal generator are stored in the RAM 42*a*, 42*b*. When Q has a value of logic "0", values are read out from the RAM 42*a*, 42*b* for use by the IDFT processor.

The comparator 32*a*, 32*b* compares the current value of the counter 41*a*, 41*b* with the value P-1. If the counter 41*a*, 41*b* has a current value less than or equal to the value P-1, the A/$\overline{B}$ inputs of the multiplexed latch 33*a*, 33*b* are set to logic "1", thereby setting the Y output of the multiplexed latch 33*a*, 33*b* to the data value from the reciprocal generator, the Y outputs of the multiplexed latch 33*a*, 33*b* being the data inputs to the RAM 42*a*, 42*b*. If the counter value is greater than the value P-1, the A/$\overline{B}$ inputs of the multiplexed latch 33*a*, 33*b* are set to logic "0", thereby setting the Y outputs of the multiplexed latch 33*a*, 33*b* to values of logic "0". The CLK (clock) inputs to the multiplexed latch 33*a*, 33*b* are connected to the AND gate 45 which provides the logical AND of the reciprocal generator timing pulses and the $\overline{Q}$ output of the J-K flip-flop device 40. When $\overline{Q}$ has a value of logic "1" and a reciprocal generator timing pulse occurs, the multiplexed latch 33*a*, 33*b* will transmit a null value of zero to the RAM 42*a*, 42*b* and will continue to do so for each counter value until the counter value reaches the value Q−1. Otherwise, the Y outputs of the multiplexed latch 33*a*, 33*b* are set to the high-impedance state so that data can be read from RAM 42*a*, 42*b* when the IDFT processor has control.

The counter 41*a*, 41*b* may comprise a paired set of 8-bit counters available as integrated circuit SN74LS592, while both paired sets of 8-bit comparators may be provided by integrated circuit SN74LS684 and the paired multiplexed latches may be provided by integrated circuit SN74LS606, all available from Texas Instruments Incorporated of Dallas, Tex. While the apparatus illustrated in FIG. 4*a*–4*c* has been specifically described as an appropriate circuit system to simulate an adjustment in the sampling period of the digital speech data from the source of synthesized speech by effecting a transformation in the synthetic speech spectrum in practicing the method for altering the voice characteristics of synthesized speech as disclosed herein, it will be understood that a suitable general purpose computer could be employed for this purpose.

Figure 5:
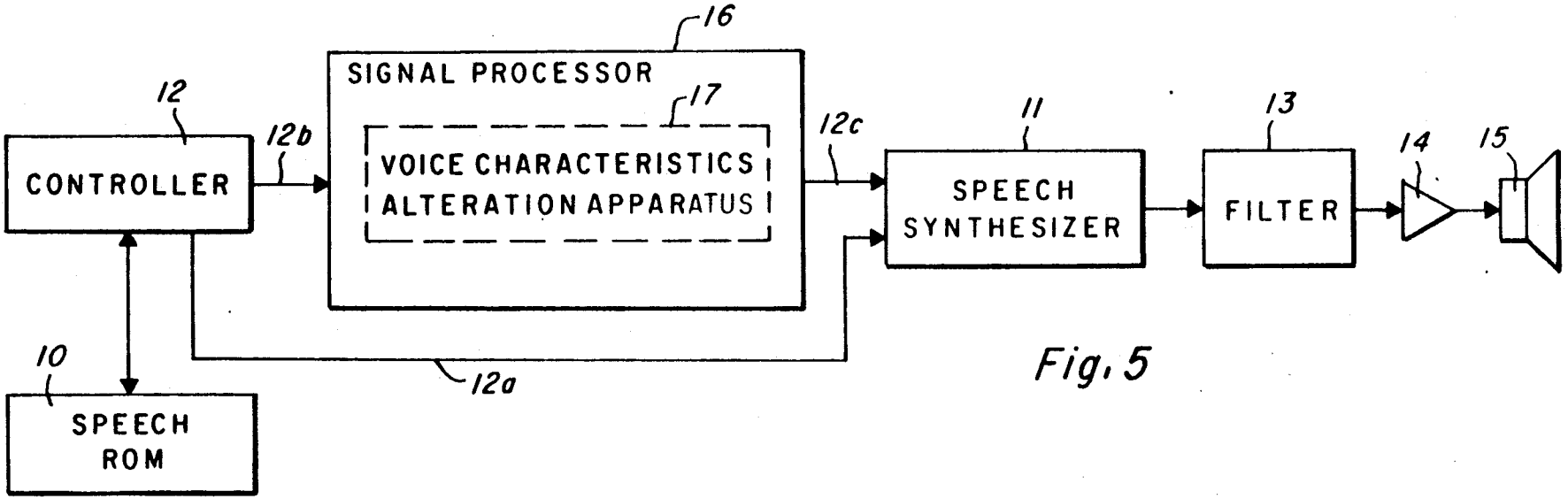
FIG. 5 is a functional block diagram of a speech synthesis system incorporating the apparatus of FIGS. 4*a*–4*e* and effective to provide a plurality of differing voice sounds having distinctly unique voice characteristics from a memory containing digital speech data of a single source of synthesized speech.

FIG. 5 illustrates a functional block diagram of a speech synthesis system in which the voice characteristics alteration apparatus of FIGS. 4*a*–4*c* is incorporated in accordance with the present invention. It will be understood that FIG. 5 shows a general purpose speech synthesis system which may be part of a text-to-synthesized speech system, as disclosed for example in the aforementioned pending U S. patent application Ser. No. 375,434 filed May 6, 1982, now U.S. Pat. No. 4,624,012, or alternately may comprise the complete speech synthesis system without the aspect of converting text material to digital codes from which synthesized speech is to be derived. To this end, the speech synthesis system of FIG. 5 includes a memory means in the form of a speech read-only-memory or ROM 10 having digital speech data and digital control data stored therein as selectively accessed by a speech synthesizer 11 under the control of a controller 12 which may take the form of a microprocessor. As described herein, the digital speech data contained in the speech ROM 10 is representative of reflection coefficients and comprises a single source of synthesized speech which is utilized by the speech synthesizer 11 in processing speech data by employing the linear predictive coding technique to obtain analog audio signals representative of human speech. The digital speech data contained in the ROM 10 may be representative of complete words or portions of words, such as allophones or phonemes which may be connected in a serial sequence under the control of the microprocessor 12 to form speech data sequences representative of a much larger number of words in relation to the storage capacity of the ROM 10. The speech ROM 10 is connected to the speech synthesizer 11 via the controller 12 through the conductor 12*a*, as shown in FIG. 5, although it will be understood that the speech ROM 10 may be directly connected to the speech synthesizer 11 but still having the digital data accessed therefrom for reception by the speech synthesizer 11 being selectively determined through the operation of the controller 12. The controller 12 is programmed as to word selection and as to voice character selection for respective words such that digital speech data as accessed from the speech ROM 10 by the controller 12 is output therefrom as preselected words (which may comprise stringing of allophones or phonemes) to which a predetermined voice characteristics profile is attributed by the establishment of magnitudes for the first and second reference factors P and Q. As previously explained , when P=Q, no change in the voice characteristics of the digital speech data stored in the speech ROM 10 occurs, and the digital speech data is selectively accessed by the speech synthesizer 11 under the control of the controller 12 via the conductor 12*a*. Appropriate audio means, such as a suitable bandpass filter 13, a preamplifier 14 and a loud speaker 15 are connected to the output of the speech synthesizer 11 to provide audible synthesized human speech from the analog audio signals produced by the speech synthesizer 11. The microprocessor forming the controller 12 may be any suitable type, such as the TMS7020 manufactured by Texas Instruments Incorporated of Dallas, Tex. which selectively accesses digital speech data and digital instructional data from the speech ROM 10 available as component TMS6100 from Texas Instruments Incorporated of Dallas, Tex.. The speech synthesizer 11 utilizes linear predictive coding in processing digital speech data to provide an analog signal output representative of synthesized human speech and may be of the type disclosed in U.S. Pat. No. 4,209,836 Wiggins, Jr. et al issued June 24, 1980 and available as component TMS5100 from Texas Instruments Incorporated of Dallas, Tex.

In accordance with the present invention, a signal processor 16 having a voice characteristics alteration apparatus 17 incorporated therewith is interposed between the controller 12 and the speech synthesizer 11. The voice characteristics alteration apparatus 17 of the signal processor 16 corresponds to the apparatus circuitry shown in FIGS. 4*a*–4*c* and effects a transformation in the speech synthesis spectrum as previously described when the digital speech data from the ROM 10 is directed under control of the controller 12 via conductor 12*b* into the signal processor 16 and output therefrom along conductor 12*c* to the speech synthesizer 11. As previously described, depending upon the magnitudes assigned to the first and second reference factors P and Q by the microprocessor 12, the voice characteristics alteration apparatus 17 produces modified k' speech parameters representative of reflection coefficients as compared to the k speech parameters originally accessed from the speech ROM 10 by the microprocessor 12. The modified k' speech parameters as input to the speech synthesizer 11 are responsible for changing the character of the audible synthesized speech produced by the loud speaker 15. In this instance, the predetermined pitch period and the predetermined speech rate remain unchanged such that the altered vocal tract model of the digital speech data as determined by the modified k' speech parameters is accompanied by the original pitch period and speech rate of the synthesized speech source for processing by the speech synthesizer 11 in providing synthesized speech with altered voice characteristics as audibly output by the loud speaker 15.

In the latter respect, the k speech parameters may be separated from the pitch and energy parameters associated therewith in respective frames of speech data as accessed by the microprocessor 12 such that the k speech parameters defining the vocal tract model of the original source of synthesized speech are directed via the conductor 12*b* through the signal processor 16 and the voice characteristics alteration apparatus 17 for input to the speech synthesizer 11 as modified k' speech parameters via conductor 12*c*, while the pitch and energy parameters bypass the signal processor 16, being transmitted via the conductor 12*a* to the speech synthesizer 11. Alternatively, the pitch and energy parameters may be passed by the conductor 12*b* through the signal processor 16 without being operated upon for input to the speech synthesizer 11 with the modified k' speech parameters via conductor 12*c*.

However, if the pitch parameter is encoded in units of the sample period, the simulated adjustment of the sampling period in affecting a transformation in the synthetic speech spectrum will require an adjustment to the coded pitch value in order to maintain the same pitch frequency existing before the transformation of the synthetic speech spectrum. This adjustment is performed by multiplying the original encoded pitch value by the ratio Q/P. For example, the speech synthesizer component TMS5100 available from Texas Instruments Incorporated of Dallas, Tex. requires this weighting of the encoded pitch parameters. Where the pitch parameters are encoded in other units, such as frequency units, or units of time as between successive pitch pulses in milliseconds, no weighting would be required.

The altered voice characteristics of the synthesized speech as produced in this manner, although capable of being interpreted as coming from a person of different age and/or sex is more likely to be of a quality regarded as non-human in origin so as to supposedly originate from fanciful or whimsical sources, such as talking animals, birds, monsters, demons, etc.

As previously described, it will be understood that a further dimension to the voice character alteration which is possible without changing the sample period with respect to the digital speech data may be achieved by independently modifying the pitch parameter magnitude and pitch contour separately from the transformation of the synthetic speech spectrum accomplished by a simulated adjustment of the sampling rate. In this respect, the present method develops an even greater flexibility than the method disclosed in the aforementioned copending U.S. application Ser. No. 375,434 filed May 6, 1982, now U.S. Pat. No. 4,624,012, in providing for independent modification of the vocal tract model, the pitch parameter and the pitch contour in developing spoken speech from a single applied source of synthesized speech having any number of voice characteristics. Thus, the voice from the source of synthesized speech may be modified to sound like that of a different person. The voice characteristics of human speech conveying impressions of age, size, temperament, and even sex of a person can thereby be altered by employing the technique disclosed herein, and voices with unnatural qualities (e.g., monotonic pitch) can also be created. Modification of the pitch parameter, for example, may be accomplished in the manner described in the previously mentioned publication, "Speech Analysis and Synthesis by Linear Prediction of the Speech Wave"-Atal & Hanauer, such as by weighting the pitch factor by a constant value.

Although this invention has been described with reference to the modification of k speech parameters or reflection coefficients defining the vocal tract model in altering the voice characteristics of synthesized speech, it will be understood that other forms of digital speech data, such as predictor coefficients, formant frequencies and Cepstrum coefficients, for example, could be utilized as the digital speech data defining the vocal tract model which is to be modified by a simulated adjustment in the sampling period effecting a transformation in the synthetic speech spectrum in the manner disclosed herein. Thus, although a preferred embodiment of the invention has been specifically described, it will be understood that the invention is to be limited only by the appended claims, since variations and modifications of the preferred embodiment will become apparent to persons skilled in the art upon reference to the description of the invention herein. Therefore, it is contemplated that the appended claims will cover any such modifications or embodiments that fall within the true scope of the invention.

What is claimed is:

1. A method of altering the voice characteristics of synthesized speech to obtain modified synthesized speech of any one of a plurality of voice sounds from a single applies source of synthesized speech, said method comprising:

providing a source of synthesized speech in the form of digital speech data corresponding to respective samples of an analog speech signal obtained at time intervals defined by a predetermined sampling period and from which synthesized speech is derivable, said digital speech data comprising frames of speech parameters provided at a predetermined speech rate, wherein each speech parameter frame has a predetermined pitch period and a predetermined vocal tract model defined by a plurality of predictor coefficients;

adding a predetermined number of null values to the plurality of predictor coefficients defining the predetermined vocal tract model for each frame of digital speech data;

changing the digital speech data from a first phase in the time domain to a second phase in the frequency domain by a first Fourier transform operation in which the added predetermined number of null values are absorbed into the digital speech data signal sequence and defining a synthetic speech spectrum;

inverting the digital speech values of the plurality of predictor coefficients defining the predetermined vocal tract model for each frame of digital speech data in the frequency domain;

establishing a first reference factor P as a first integer equal to a selected number of predetermined points spanning the speech spectrum as determined by the type of voice desired to be made in a Fourier transform operation;

establishing a second reference factor O as a second integer of unequal magnitude with respect to said first integer providing said first reference factor P, said second integer being an even number corresponding to an arbitrary number of points spanning the extent of the speech spectrum;

simulating an adjustment in the sampling period related to the digital speech data from said source of synthesized speech based upon the inequality between said first and second reference factors P and O, wherein said second integer providing said second reference factor O = the nearest even integer to the product of $P \times F_{NEW}/F_{OLD}$, where $F_{NEW}$ = the desired apparent sampling frequency of the simulated adjusted sampling period; and $F_{OLD}$ = the implied sampling frequency of the predetermined sampling period;

altering the predetermined vocal tract model of the digital speech data in response to the simulated adjustment in the sampling period by compressing the synthesized speech spectrum if said first integer providing said first reference factor P is greater in magnitude than said second integer providing said second reference factor O, or by expanding the synthesized speech spectrum if said first integer providing said first reference factor P is of lesser magnitude than said second integer providing said second reference factor O;

producing modified digital speech data as a digitized speech waveform providing an impulse response from which the predetermined pitch period and amplitude data have been deleted by returning the compressed or expanded synthesized speech spectrum to said first phase in the time domain from said second phase in the frequency domain by a second Fourier transform operation;

analyzing said digitized speech waveform in providing the modified digital speech data having an altered vocal tract model as a plurality of predictor coefficients;

converting said plurality of predictor coefficients defining said altered vocal tract model to reflection coefficients;

generating audio signals representative of human speech from the modified digital speech data as represented by reflection coefficients; and converting said audio signals into audible synthesized speech having altered voice characteristics from the synthesized speech which would have been obtained from said source of synthesized speech.

2. A method as set forth in claim 1, wherein only the vocal tract model of said digital speech data is altered by said simulated adjustment in the sampling period of said digital speech data, with said predetermined pitch period and said predetermined speech rate of said source of synthesized speech remaining the same.

3. A method as set forth in claim 2, wherein the synthesized speech spectrum is compressed in that said first reference factor P is established at a magnitude greater than that at which said second reference factor O is established, and said simulated adjustment in the sampling period of said digital speech data from said source of synthesized speech is provided by deleting a plurality of samples corresponding to the difference in magnitude between said first and second reference factors P and O from the spectrum signal sequence representative of said digital speech data; and thereafter producing said modified digital speech data having altered voice characteristics.

4. A method as set forth in claim 3, wherein the plurality of samples are deleted from the middle of the spectral signal sequence in effecting said simulated adjustment in the sampling period of said digital speech data from said source of synthesized speech.

5. A method as set forth in claim 3, wherein said plurality of samples are deleted from the end of the spectral signal sequence in effecting said simulated adjustment in the sampling period of said digital speech data from said source of synthesized speech.

6. A method as set forth in claim 2, wherein the synthesized speech spectrum is expanded in that said first reference factor P is established at a magnitude less than that at which said second reference factor O is established, and said simulated adjustment in the sampling period of said digital speech data from said source of synthesized speech is provided by adding a plurality of null values corresponding to the difference in magnitude as between said second reference factor O and said first reference factor P to the spectral signal sequence representative of said digital speech data; and thereafter producing said modified digital speech data having altered voice characteristics.

7. A method as set forth in claim 6, wherein said plurality of null values are added to the middle of said spectral signal sequence in effecting said simulated adjustment in the sampling period of said digital speech data from said source of synthesized speech.

8. A method as set forth in claim 6, wherein said plurality of null values are added to the end of the spectral signal sequence in effecting said simulated adjustment in the sampling period of said digital speech data from said source of synthesized speech.

9. A method as set forth in claim 1, wherein said first reference factor P is a number equal to the number of predetermined points as determined by the type of voice desired to be made in the inverse discrete Fourier transform, and said second reference factor O is an even number of points in the inverse discrete Fourier transform; and 10. A method as set forth in claim 1, wherein a total of $P-(N+1)$ null values are added to the plurality of predictor coefficients prior to the first Fourier transform operation, where $N$=the number or predictor coefficients defining the predetermined vocal tract model.

11. A method of altering the voice characteristics of synthesized speech to obtain modified synthesized speech of any one of a plurality of voice sounds from a single applied source of synthesized speech, said method comprising:

providing a source of synthesized speech in the form of digital speech data corresponding to respective samples of an analog speech signal obtained at time intervals defined by a predetermined sampling period and from which synthesized speech is derivable, said digital speech data comprising frames of speech parameters provided at a predetermined speech rate, wherein each speech parameter frame has a predetermined pitch period and a predetermined vocal tract model defined by a plurality of predictor coefficients;

adding a predetermined number of null values to the plurality of predictor coefficients defining the predetermined vocal tract model for each frame of digital speech data;

changing the digital speech data from a first phase in the time domain to a second phase in the frequency domain by a first Fourier transform operation in which the added predetermined number of null values are absorbed into the digital speech data signal sequence and defining a synthetic speech spectrum;

inverting the digital speech values of the plurality of predictor coefficients defining the predetermined vocal tract model for each frame of digital speech data in the frequency domain;

establishing a first reference factor P as a first integer, said first integer being an even number equal to the number of predetermined points spanning the speech spectrum as determined by the desired modified synthesized speech to be created in an inverse fast Fourier transform operation;

establishing a second reference factor O as a second integer of unequal magnitude with respect to said first integer providing said first reference factor P, said second integer being an even number of points in the inverse fast Fourier transform having a power of 2 and corresponding to an arbitrary number of points spanning the extent of the speech spectrum;

simulating an adjustment in the sampling period related to the digital speech data from said source of synthesized speech based upon the inequality between said first and second reference factors P and O, wherein said first integer providing said first reference factor P=the nearest even integer to the product of $Q \times F_{OLD}/F_{NEW}$, where $F_{OLD}$=the implied sampling frequency of the predetermined sampling period; and $F_{NEW}$=the desired apparent sampling frequency of the simulated adjusted sampling period;

altering the predetermined vocal tract model of the digital speech data in response to the simulated adjustment in the sampling period by compressing the synthesized speech spectrum if said first integer providing said first reference factor P is greater in magnitude than said second integer providing said second reference factor O, or by expanding the synthesized speech spectrum if said first integer providing said first reference factor P is of lesser magnitude than said second integer providing said second reference factor O;

producing modified digital speech data as a digitized speech waveform providing an impulse response from which the predetermined pitch period and amplitude data have been deleted by returning the compressed or expanded synthesized speech spectrum to said first phase in the time domain from said second phase in the frequency domain by a second Fourier transform operation employing an inverse fast Fourier transform;

analyzing said digitized speech waveform in providing the modified digital speech data having an altered vocal tract model as a plurality of predictor coefficients;

converting said plurality of predictor coefficients defining said altered vocal tract model to reflection coefficients;

generating audio signals representative of human speech from the modified digital speech data as represented by reflection coefficients; and converting said audio signals into audible synthesized speech having altered voice characteristics from the synthesized speech which would have been obtained from said source of synthesized speech.

12. A method as set forth in claim 11, wherein only the vocal tract model of said digital speech data is altered by said simulated adjustment in the sampling period of said digital speech data, with said predetermined pitch period and said predetermined speech rate of said source of synthesized speech remaining the same.

13. A method as set forth in claim 12, wherein the synthesized speech spectrum is compressed in that said first reference factor P is established at a magnitude greater than that at which said second reference factor O is established, and said simulated adjustment in the sampling period of said digital speech data from said source of synthesized speech is provided by deleting a plurality of samples corresponding to the difference in magnitude between said first and second reference factors P and O from the spectral signal sequence representative of said digital speech data; and thereafter producing said modified digital speech data having altered voice characteristics

14. A method as set forth in claim 13, wherein the plurality of samples are deleted from the middle of the spectral signal sequence in effecting said simulated adjustment in the sampling period of said digital speech data from said source of synthesized speech.

15. A method as set forth in claim 13, wherein said plurality of samples are deleted from the end of the spectral signal sequence in effecting said simulated adjustment in the sampling period of said digital speech data from said source of synthesized speech.

16. A method as set forth in claim 12, wherein the synthesized speech spectrum is expanded in that said first reference factor P is established at a magnitude less than that at which said second reference factor O is established, and said simulated adjustment in the sampling period of said digital speech data from said source of synthesized speech is provided by adding a plurality of null values corresponding to the difference in magnitude as between said second reference factor O and said first reference factor P to the spectral signal sequence representative of said digital speech data; and thereafter producing said modified digital speech data having altered voice characteristics.

17. A method as set forth in claim 16, wherein said plurality of null values are added to the middle of said spectral signal sequence in effecting said simulated adjustment in the sampling period of said digital speech data from said source of synthesized speech.

18. A method as set forth in claim 16, wherein said plurality of null values are added to the end of the spectral signal sequence in effecting said simulated adjustment in the sampling period of said digital speech data from said source of synthesized speech.

19. A method as set forth in claim 11, wherein a total of $P-(N+1)$ null values are added to the plurality of predictor coefficients prior to the first Fourier transform operation, where $N$=the number of predictor coefficients defining the predetermined vocal tract model.

* * * * *